US009229350B2

(12) United States Patent
Okamoto et al.

(10) Patent No.: US 9,229,350 B2
(45) Date of Patent: Jan. 5, 2016

(54) IMAGE FORMING APPARATUS

(75) Inventors: Tetsuji Okamoto, Kanagawa (JP); Atsuyuki Kitamura, Kanagawa (JP); Masahiro Sato, Kanagawa (JP); Atsushi Ogihara, Kanagawa (JP); Junichi Murakami, Kanagawa (JP); Shuichi Nishide, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 233 days.

(21) Appl. No.: 12/768,193

(22) Filed: Apr. 27, 2010

(65) Prior Publication Data

US 2011/0044744 A1 Feb. 24, 2011

(30) Foreign Application Priority Data

Aug. 19, 2009 (JP) ..... 2009-189747

(51) Int. Cl.
*G03G 15/00* (2006.01)
*G03G 15/01* (2006.01)

(52) U.S. Cl.
CPC .... *G03G 15/0163* (2013.01); *B65H 2405/3321* (2013.01); *B65H 2405/3322* (2013.01); *G03G 15/0173* (2013.01); *G03G 2215/0177* (2013.01)

(58) Field of Classification Search
CPC ..... B65H 2405/3321; G03G 21/1609; G03G 2215/135; G03G 15/6579
USPC ..... 399/389, 394, 405, 125, 388, 401; 400/624, 625
See application file for complete search history.

(56) References Cited

U.S. PATENT DOCUMENTS

| | | | | |
|---|---|---|---|---|
| 5,926,684 | A * | 7/1999 | Horiuchi et al. | 399/402 |
| 6,106,178 | A * | 8/2000 | Chiu | 400/624 |
| 2002/0149805 | A1 * | 10/2002 | Tanaka et al. | 358/498 |
| 2004/0005159 | A1 * | 1/2004 | Ito et al. | 399/50 |
| 2005/0207771 | A1 * | 9/2005 | Kameda | 399/68 |
| 2005/0253096 | A1 * | 11/2005 | Ishida et al. | 250/582 |
| 2006/0062591 | A1 | 3/2006 | Oda | |
| 2008/0118291 | A1 * | 5/2008 | Uehara | 399/400 |

FOREIGN PATENT DOCUMENTS

| | | |
|---|---|---|
| CN | 1 749869 A | 3/2006 |
| CN | 1755550 | 4/2006 |
| JP | A-H09-124185 | 5/1997 |
| JP | A-11-139619 | 5/1999 |

(Continued)

OTHER PUBLICATIONS

JP 2006349701 machine translation.*
Chinese Office Action dated Dec. 25, 2013 from Chinese Patent Application No. 20100179217.5 (with English-language translation).

(Continued)

*Primary Examiner* — Matthew G Marini
*Assistant Examiner* — Ruben Parco, Jr.
(74) *Attorney, Agent, or Firm* — Oliff PLC

(57) ABSTRACT

An image forming apparatus includes an image carrier; a transferring unit; a fixing unit; a conveying unit; and a sheet shape detecting unit as defined herein, and a discharge position where the sheet is discharged from the conveying path, a feed position where the sheet is fed to the sheet conveying path and a detection position where the shape of the sheet is detected by the sheet shape detecting unit are arranged in this sequence along a sheet conveying direction to be close to one another, immediately downstream in the sheet conveying direction from a fixing position where the toner image is fixed to the sheet.

4 Claims, 7 Drawing Sheets

FIG. 1

(56) References Cited

FOREIGN PATENT DOCUMENTS

| | | |
|---|---|---|
| JP | A-2005-70206 | 3/2005 |
| JP | A 2006-349701 | 12/2006 |
| JP | A-2007-304170 | 11/2007 |

OTHER PUBLICATIONS

Korean Office Action dated Oct. 2, 2013 from Korean Patent Application No. 10-2010-0042867 (with English-language translation).
Sep. 2, 2014 Office Action issued in Chinese Patent Application No. 201010179217.5 (with translation).

* cited by examiner

IMAGE FORMING APPARATUS

CROSS-REFERENCE TO RELATED APPLICATIONS

This application is based on and claims priority under 35 USC 119 from Japanese Patent Application No. 2009-189747 filed on Aug. 19, 2009.

BACKGROUND

1. Technical Field

The present invention relates to an image forming apparatus.

2. Related Art

A color image forming apparatus is known in which toner images of a plurality of colors are sequentially formed on a photosensitive member, and the toner images of a plurality of colors are transferred and fixed to a sheet to form a multi-color image.

SUMMARY

According to an aspect of the invention, there is provided an image forming apparatus including: an image carrier on which a toner image of a single color is formed; a transferring unit that transfers the toner image formed on the image carrier to a sheet; a fixing unit that fixes the toner image transferred to the sheet; a conveying unit that conveys the sheet along a conveying path that circulates around the image carrier, to allow transferring and fixing of the toner image to the sheet repeatedly so that a toner image of a plurality of colors is formed on the sheet; and a sheet shape detecting unit that detects a shape of the sheet that is conveyed through the conveying path, wherein a discharge position where the sheet is discharged from the conveying path, a feed position where the sheet is fed to the sheet conveying path and a detection position where the shape of the sheet is detected by the sheet shape detecting unit are arranged in this sequence along a sheet conveying direction to be close to one another, immediately downstream in the sheet conveying direction from a fixing position where the toner image is fixed to the sheet.

BRIEF DESCRIPTION OF THE DRAWINGS

Exemplary embodiments of the present invention will be described in detail based on the following figures, wherein.

DESCRIPTION OF REFERENCE NUMERALS AND SIGNS

1 image forming apparatus, 10 image carrier, 20 developing device, 30 transferring device, 40 fixing device, 50 conveying mechanism, 51 conveying path, 51-1 first path portion, 51-2 second path portion, 52 feeding path, 53 pickup roller, 54 conveying roller, 55 discharging path, 56 switching claw, 60 sheet shape detecting device, 70 feed sheet housing portion, 80 discharge sheet housing portion, 90 controlling device.

DETAILED DESCRIPTION

Hereinafter, an exemplary embodiment of the invention will be described with reference to the drawings.

Figure 1:
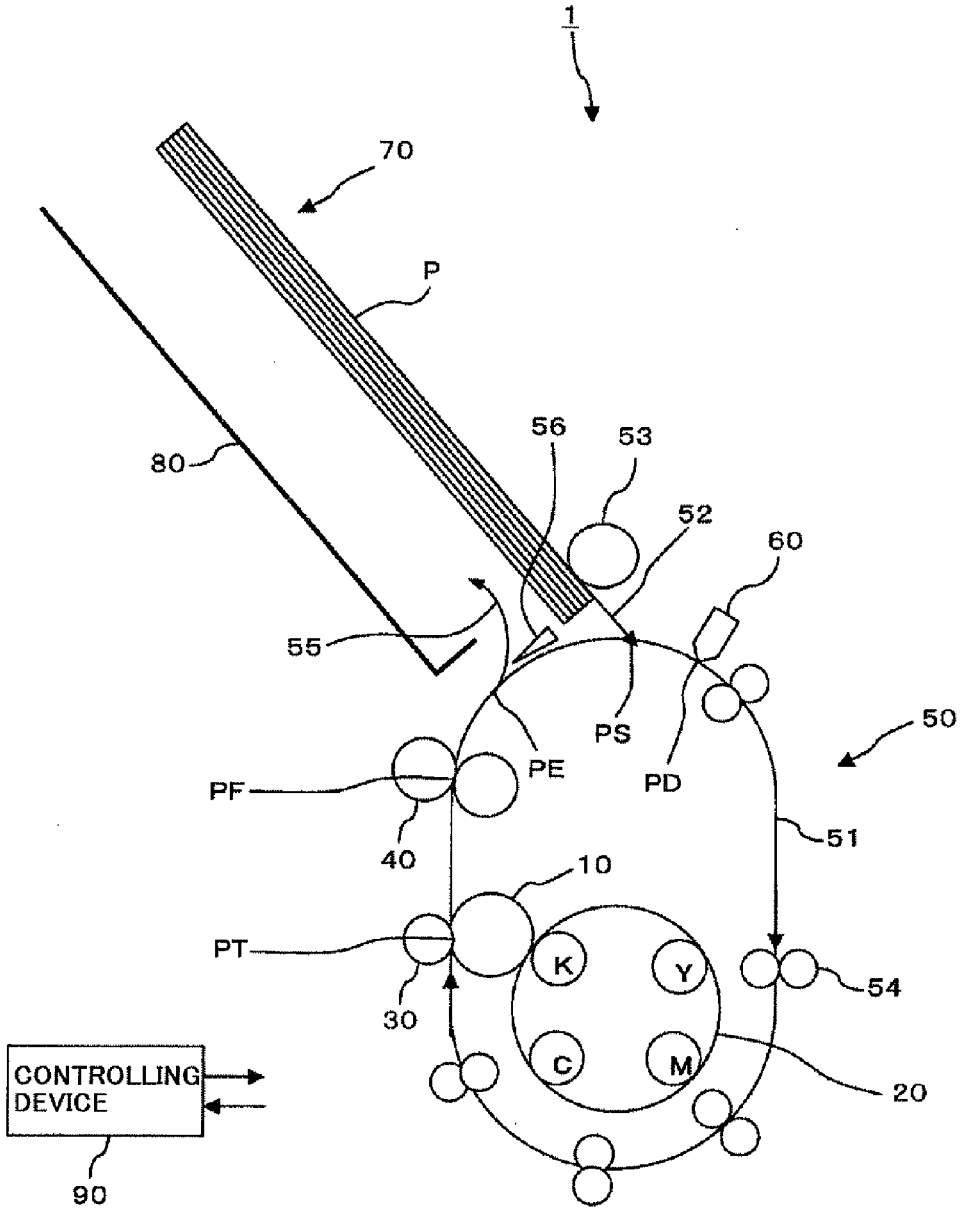
FIG. 1 is a diagram showing an example of the configuration of an image forming apparatus of an exemplary embodiment.

FIG. 1 is a diagram showing an example of the configuration of an image forming apparatus 1 of the exemplary embodiment. In the image forming apparatus 1, steps of transferring and fixing a toner image to a sheet are repeated a plurality of times to form a multi-color image on the sheet.

Referring to FIG. 1, the image forming apparatus 1 has an image carrier 10, a developing device 20, a transferring device 30, a fixing device 40, a conveying mechanism 50, a sheet shape detecting device 60, a feed sheet housing portion 70, a discharge sheet housing portion 80, and a controlling device 90.

The image carrier 10 is a member on which a toner image of a single color is to be formed, and is, for example, a photosensitive member. In the example of FIG. 1, the image carrier 10 is a drum-like photosensitive member. Alternatively, the image carrier 10 may have another shape such as a belt-like shape. Specifically, an electrostatic latent image of respective color is formed on the surface of the image carrier 10, and the electrostatic latent image is developed by respective toner to form a toner image. In an embodiment, four colors of yellow (Y), magenta (M), cyan (C) and black (K) are used. The kinds and number of colors may be other than those described above.

The developing device 20 develops the electrostatic latent image formed on the image carrier 10 to sequentially form a toner image of each of the plurality of colors one by one on the image carrier 10. In an embodiment, the developing device 20 includes developers respectively for the plurality of colors, and a mechanism which switches over a developer to be used in the developing process. In the example of FIG. 1, the developing device 20 includes: four developers which respectively perform the developing process by using toners of Y, M, C, and K; and a holding member which holds the four developers to be rotatable about a rotation axis. The holding member rotates about the rotation axis integrally with the four developers to switch over the developer opposed to the image carrier 10 (i.e., the developer to be used in the developing process).

The transferring device 30 transfers a toner image formed on the image carrier 10 to a sheet P. Specifically, the transferring device 30 electrostatically transfers a toner image to the sheet P, and, in the example of FIG. 1, is a transferring roller.

The fixing device 40 fixes the toner image which is transferred to the sheet P by the transferring device 30. Specifically, the fixing device 40 fixes the toner image onto the sheet P by means of heat and pressure, and, in the example of FIG. 1, includes a heating roller which heats the toner image, and a pressure roller which is in contact with the heating roller in a pressurized state.

In a specific embodiment, although not shown in FIG. 1, a charging device which uniformly charges the surface of the image carrier 10, and an exposing device which exposes the surface of the image carrier 10 that is charged by the charging device, to form an electrostatic latent image are disposed on the upstream side of the developing device 20 in the rotational direction of the image carrier 10. A cleaning device which removes toners remaining on the image carrier 10 is disposed on the downstream side of the transferring device 30. In the downstream of the transferring device 30, and in the upstream of the developing device 20, namely, the cleaning device, the charging device, and the exposing device are sequentially arranged along the rotational direction of the image carrier 10.

The conveying mechanism 50 conveys the sheet P along a conveying path 51 which circulates around the image carrier 10, to allow the steps of transferring and fixing a toner image to the sheet P to be repeated a plurality of times so that a toner image of the plurality of colors is formed on the sheet P.

Specifically, the conveying mechanism 50 includes a guiding member for guiding the sheet P along the conveying path 51, a driving member which drives the sheet P in the conveying direction, etc.

In the example of FIG. 1, the conveying mechanism 50 includes: a feeding path 52 through which the sheet P to be fed to the conveying path 51 is conveyed; a pickup roller 53 which feeds one by one the sheet P housed in the feed sheet housing portion 70, to the feeding path 52; a conveying roller 54 which conveys the sheet P fed from the feeding path 52, along the conveying path 51; a discharging path 55 through which the sheet P discharged from the conveying path 51 is conveyed; and a switching claw 56 which switches the conveying path for the sheet P from the conveying path 51 to a discharging path 55.

The sheet shape detecting device 60 detects the shape of the sheet P which is conveyed through the sheet conveying path 51. For example, the sheet shape detecting device 60 includes an optical or mechanical sensor, but the detecting method is not particularly restricted. The sheet shape detecting device 60 is requested to detect information indicative of the shape of the sheet, and detects, for example, the length of the sheet in the sheet conveying direction (i.e., the length in the sub-scanning direction), that of the sheet in the width direction (i.e., the length in the main scanning direction), the inclinations of the front and rear ends of the sheet, the positions of end portions (for example, the front right and left ends, and the rear right and left ends) of the sheet, and the outline shape of the whole sheet.

The feed sheet housing portion 70 houses the sheet P which is to be fed to the conveying path 51, and is configured by, for example, one or more sheet feed trays.

The discharge sheet housing portion 80 houses the sheet P which is discharged from the conveying path 51, and is configured by, for example, one or more sheet discharge trays.

The controlling device 90 controls the operation of the image forming apparatus 1. Specifically, the controlling device 90 controls the image carrier 10, the developing device 20, the transferring device 30, the fixing device 40, the conveying mechanism 50, and the like so as to overlappingly form toner images of Y, M, C, and K on the sheet P, thereby producing the sheet P on which a color image is printed.

Based on a result of the detection of the sheet shape detecting device 60, the controlling device 90 performs a control for aligning the positions of the color images which are to be formed on the sheet P. Specifically, the controlling device 90 performs a control for correcting a color shift (color registration shift) due to deformation of the sheet P which has undergone the fixing process.

In an embodiment, based on the result of the detection of the sheet shape detecting device 60, the controlling device 90 corrects the electrostatic latent images or toner images which are formed on the image carrier 10, thereby performing alignment of positions of the colors (color registration). Specifically, on the basis of a comparison of the shape of the sheet which has not undergone the first transferring process, and that of the sheet which has not undergone the second or subsequent transferring process, the controlling device 90 corrects the second or subsequent electrostatic latent image or toner image so that the positions of the toner images which are formed on the sheet in the second or subsequent transferring process coincide with the position of the toner image which is formed on the sheet in the first transferring process. Taking a simple example in which the length of the sheet in the main scanning direction before the first transferring process is W1, that in the sub-scanning direction is L1, the length of the sheet in the main scanning direction before the second transferring process is W2, and that in the sub-scanning direction is L2, the image correction is performed so that the length of the electrostatic latent image in the main scanning direction in the second transferring process is W2/W1 times that in the first transferring process, and that in the sub-scanning direction is L2/L1 times that in the first transferring process. Alternatively, the controlling device 90 may perform positioning by using a method other than the image correction, such as correction of the sheet conveying speed.

In an embodiment, the controlling device 90 is realized by cooperation of a hardware resource and software. Specifically, the controlling device 90 includes a recording medium on which a program is recorded, a main memory, and a CPU (Central Processing Unit), and the function of the controlling device 90 is realized by reading out the program recorded on the recording medium to the main memory, and causing the CPU to execute the program. The program may be provided by recording the program on a recording medium which is readable by a computer, such as a CD-ROM, or by communication of a data signal. The controlling device 90 may be realized only by a hardware. Alternatively, the controlling device 90 may be realized by a physically single device, or by physically plural devices.

Next, the operation of the image forming apparatus 1 of the exemplary embodiment will be described by exemplifying the case where toner images of Y, M, C, and K are sequentially formed on one sheet in an overlapping manner, to obtain one color printed matter.

The controlling device 90 controls the conveying mechanism 50 so as to take up one by one sheets P housed in the feed sheet housing portion 70, and conveys the taken-up sheet along the conveying path 51. During the period until the sheet P reaches the transfer position PT, a first detection of the sheet shape is performed by the sheet shape detecting device 60, and the controlling device 90 obtains a result of the first detection of the sheet shape detecting device 60.

On the other hand, the controlling device 90 forms an electrostatic latent image on the image carrier 10 on the basis of image data of Y, and controls the developer for Y so as to develop the electrostatic latent image, thereby forming the toner image of Y on the image carrier 10.

Then, the controlling device 90 conveys the sheet P to the transfer position PT so that the front end of the sheet P is aligned with that of the toner image of Y, controls the transferring device 30 so as to transfer the toner image of Y onto the sheet P, and then controls the fixing device 40 to fix the toner image of Y onto the sheet P.

In order to form the toner image of the next color (M) on the sheet P onto which the toner image of Y is fixed, the controlling device 90 conveys the sheet P which has undergone the fixing process, along the conveying path 51. During the period until the sheet P again reaches the transfer position PT, a second detection of the sheet shape is performed by the sheet shape detecting device 60, and the controlling device 90 obtains a result of the second detection of the sheet shape detecting device 60.

The controlling device 90 forms an electrostatic latent image on the image carrier 10 on the basis of image data of M, and controls the developer for M so as to develop the electrostatic latent image, thereby forming the toner image of M on the image carrier 10. At this time, based on the first and second detection results, the controlling device 90 forms the electrostatic latent image while correcting the image data or image formation conditions (for example, exposure conditions) so that, on the sheet P, the position of the toner image of Y coincides with that of the toner image of M.

Then, the controlling device 90 conveys the sheet P to the transfer position PT so that the front end of the sheet P is aligned with that of the toner image of M, controls the transferring device 30 so as to transfer the toner image of M onto the sheet P, and then controls the fixing device 40 to fix the toner image of M onto the sheet P.

In order to form the toner image of the next color (C), in the same manner as the case of M, the controlling device 90 conveys the sheet P which has undergone the fixing process, along the conveying path 51. During the period until the sheet P again reaches the transfer position PT, a third detection of the sheet shape is performed by the sheet shape detecting device 60, and the controlling device 90 obtains a result of the third detection.

The controlling device 90 forms an electrostatic latent image on the image carrier 10 on the basis of image data of C, and controls the developer for C so as to develop the electrostatic latent image, thereby forming the toner image of C on the image carrier 10. At this time, based on the first and third detection results, the controlling device 90 forms the electrostatic latent image while correcting the image data or image formation conditions so that, on the sheet P, the position of the toner image of Y coincides with that of the toner image of C.

In the same manner as the cases of M and C, then, the controlling device 90 conveys the sheet P which has undergone the fixing process, along the conveying path 51, and toner image of K is transferred and fixed onto the sheet P. In this case, the controlling device 90 receives a result of the fourth detection, and, based on the first and fourth detection results, corrects the image data or image formation conditions so that, on the sheet P, the position of the toner image of Y coincides with that of the toner image of K.

The controlling device 90 controls the switching claw 56 to switch the conveying direction of the sheet P from the conveying path 51 to the discharging path 55, so that the sheet P on which the toner images of the four colors are overlappingly formed is discharged to the discharge sheet housing portion 80.

In the case where images are to be consecutively formed on two or more sheets, the above-mentioned processes are repeated. In this case, in view of the productivity and the like, for example, the subsequent sheet is conveyed while forming a predetermined gap with respect to the preceding sheet.

Hereinafter, the arrangement of the components of the image forming apparatus 1 of the exemplary embodiment will be described.

First, the arrangement of a discharge position PE where a sheet is discharged from the conveying path 51, a feed position PS where a sheet is fed to the conveying path 51, and a detection position PD where the shape of a sheet is detected by the sheet shape detecting device 60 will be described.

As described above, an image forming apparatus is requested to be miniaturized, and, on the other hand, the length of the sheet conveying path extending from the detection position PD to the transfer position Pt is desired to be ensured to some extent so that the sheet shape can be detected in a long range in the sheet conveying direction, from the viewpoints of accurate positioning of color images on the sheet, and the like.

In the exemplary embodiment, from the viewpoints such as that the apparatus is miniaturized, while ensuring the length of the sheet conveying path extending from the detection position PD to the transfer position PT, therefore, the discharge position PE, the feed position PS, and the detection position PD are arranged in this sequence along the sheet conveying direction so as to be close to one another, immediately downstream in the sheet conveying direction from a fixing position PF where a toner image is fixed to a sheet.

Figure 2:
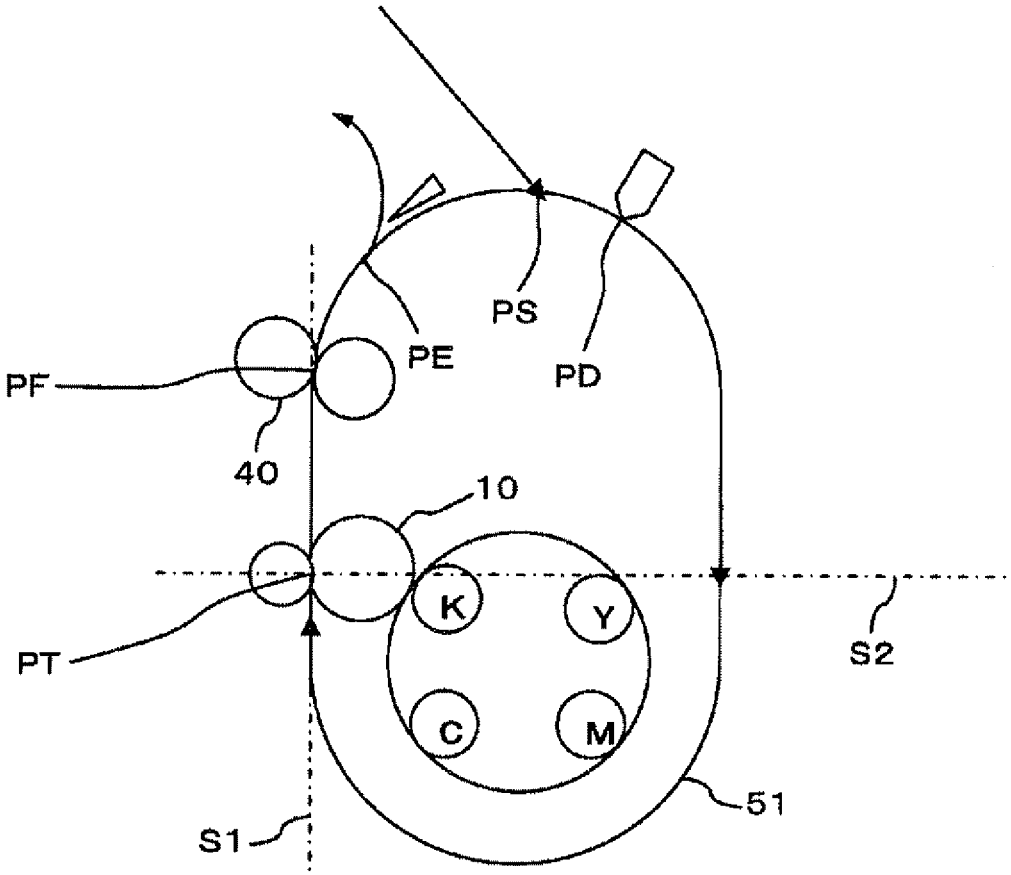
FIG. 2 is a view illustrating the arrangement of a discharge position, a feed position, and a detection position.

In an embodiment, specifically, the discharge position PE, the feed position PS, and the detection position PD are placed on the same side with respect to the image carrier 10. More specifically, as shown in FIG. 2, the discharge position PE, the feed position PS, and the detection position PD are placed on the same side with respect to a plane S2 which is perpendicular to a plane S1 connecting the transfer position PT to the fixing position PF, and which passes through the transfer position PT.

Figure 3:
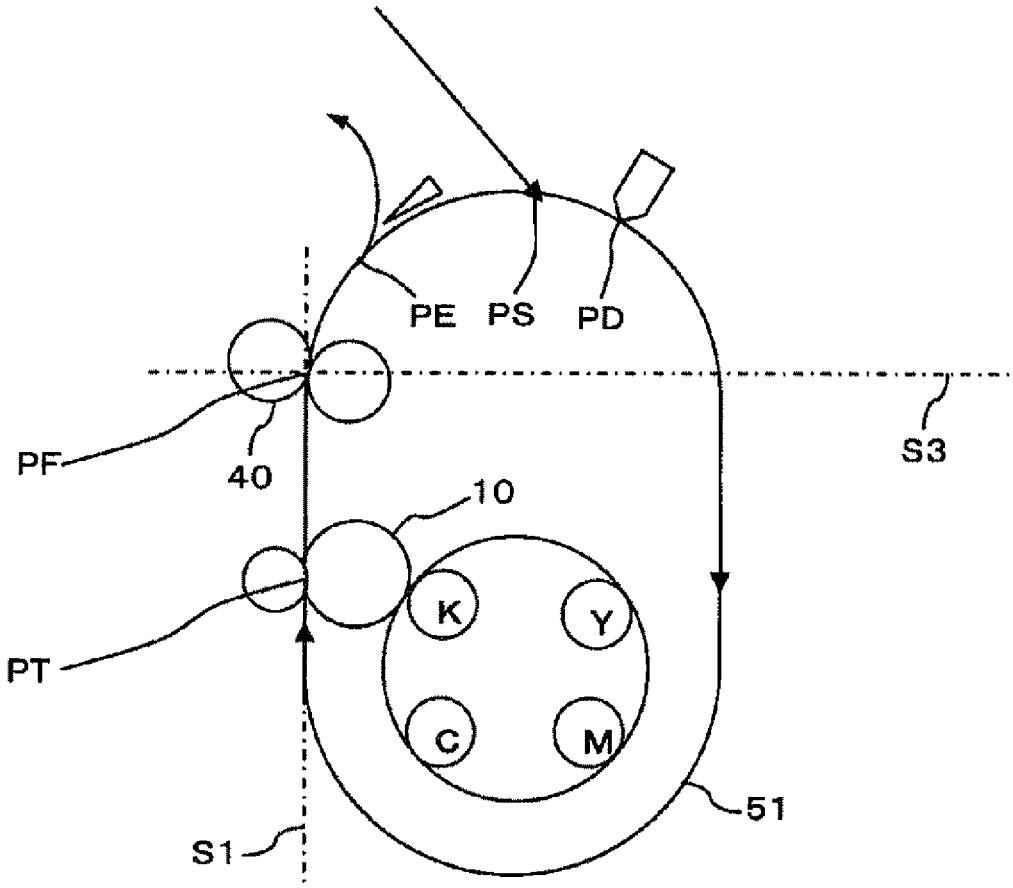
FIG. 3 is a view illustrating the arrangement of the discharge position, the feed position, and the detection position.

In another embodiment, the discharge position PE, the feed position PS, and the detection position PD are placed on the same side with respect to the fixing device 40. More specifically, as shown in FIG. 3, the discharge position PE, the feed position PS, and the detection position PD are placed on the same side with respect to a plane S3 which is perpendicular to the plane S1 connecting the transfer position PT to the fixing position PF, and which passes through the fixing position PF.

Figure 4:
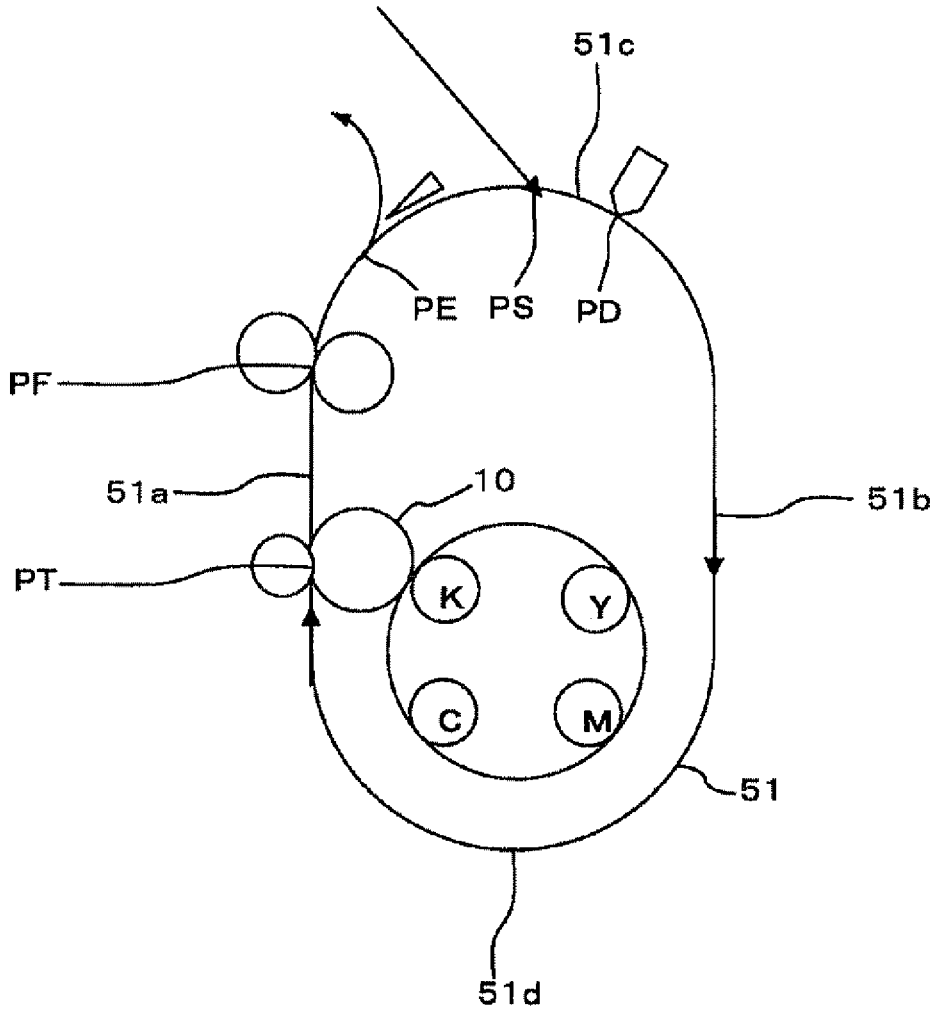
FIG. 4 is a view illustrating the arrangement of the discharge position, the feed position, and the detection position.

In a further embodiment, as shown in FIG. 4, the conveying path 51 includes: an approximately linear path portion 51*a* which extends from the transfer position PT to the fixing position PF; an approximately linear path portion 51*b* which is opposed to the path portion 51*a* across the image carrier 10, and which conveys a sheet in the direction opposite to that of the linear path portion 51*a*; a curved path portion 51*c* which conveys a sheet fed from the path portion 51*a*, to the path portion 51*b*; and a curved path portion 51*d* which conveys a sheet fed from the path portion 51*b*, to the path portion 51*a*. The discharge position PE, the feed position PS, and the detection position PD are placed in the range of the path portion 51*c*.

From the viewpoints of more accurate positioning of color images, further suppression of dispersion of the color registration, and the like, it is preferred to detect the shape of a sheet over the entire length of the sheet in the sheet conveying direction.

In an embodiment, therefore, the detection position PD is separated from the transfer position PT where a toner image is transferred to a sheet, by the length of the sheet in the sheet conveying direction or longer. Based on a result of the detection of the entire length of the sheet in the sheet conveying direction, the controlling device 90 performs the control for aligning the positions of images. In the case where sheets of a plurality of kinds of sizes are conveyed, for example, the detection position PD is placed so as to be separated from the transfer position PT by the maximum sheet length or longer.

Next, the arrangement of the feed sheet housing portion 70, the discharge sheet housing portion 80, and the conveying path 51 will be described.

From the viewpoints of avoiding or reducing an influence of interaction between the transferring and fixing processes on an image, and the like, the portion of the conveying path 51 which extends from the transfer position PT to the fixing position PF is set to be relatively long. In an embodiment, therefore, the conveying path 51 has a shape which is elongated in the direction of the portion from the transfer position PT to the fixing position PF.

Figure 5:
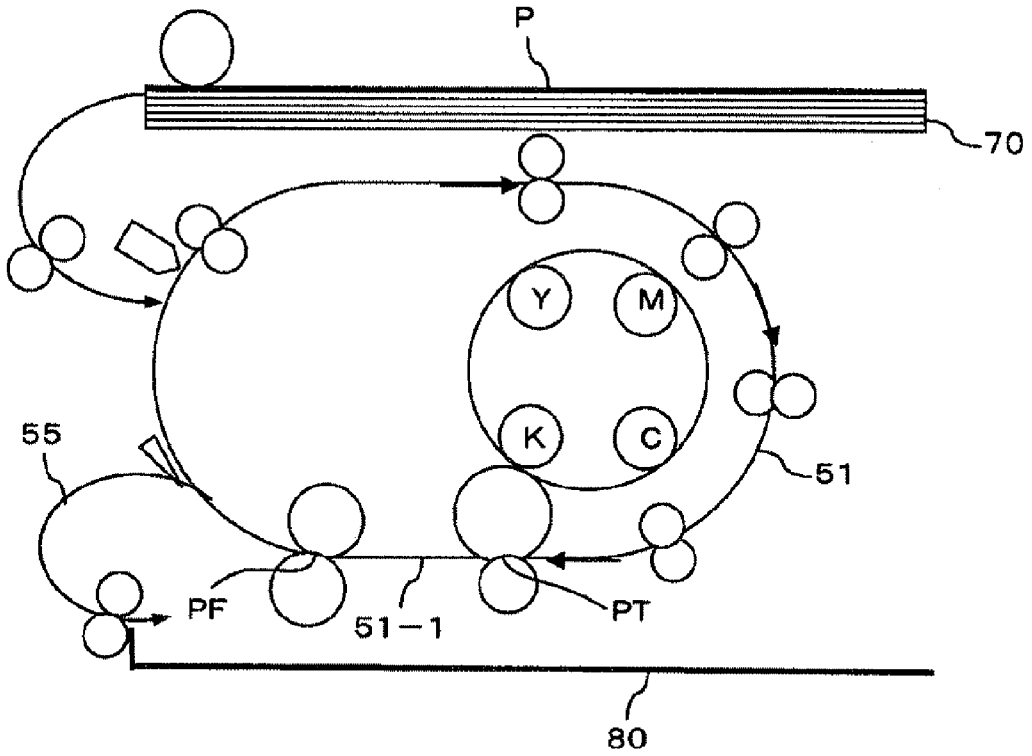
FIG. 5 is a view showing an example of the arrangement of a feed sheet housing portion, a discharge sheet housing portion, and a conveying path.
Figure 6:
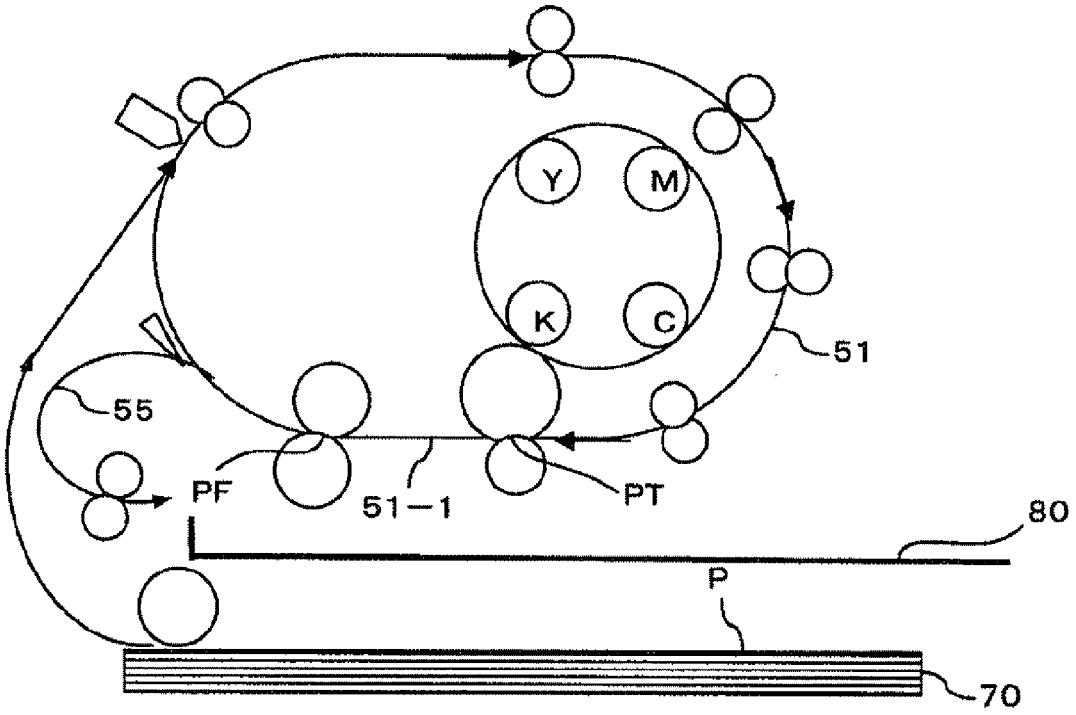
FIG. 6 is a view showing another example of the arrangement of the feed sheet housing portion, the discharge sheet housing portion, and the conveying path.
Figure 7:
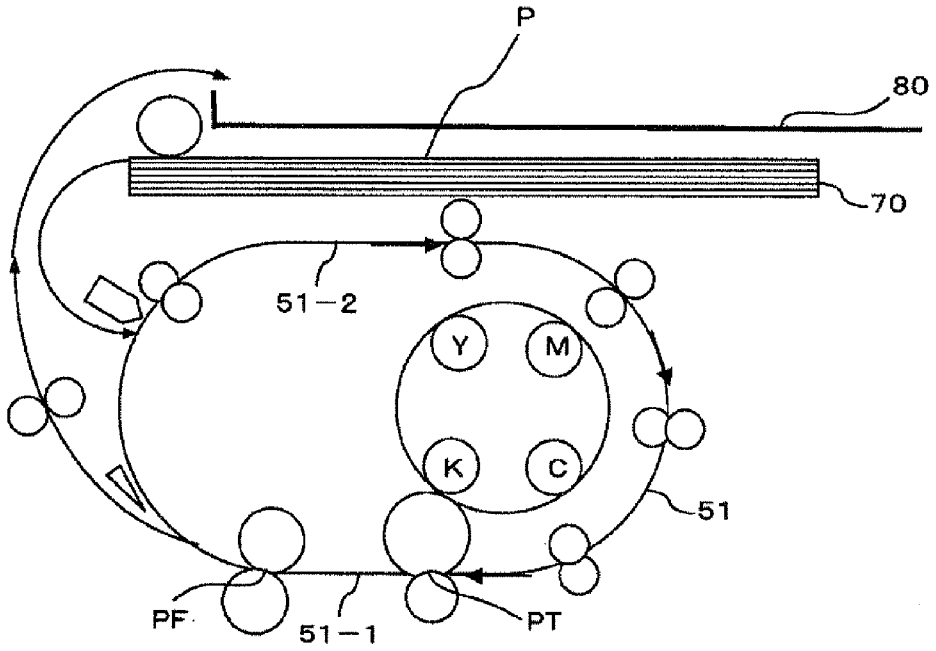
FIG. 7 is a view showing a further example of the arrangement of the feed sheet housing portion, the discharge sheet housing portion, and the conveying path.

In an embodiment, considering the above, from the viewpoints of reducing the dead space, improving the space efficiency, and the like, the feed sheet housing portion 70 and the discharge sheet housing portion 80 are placed so that, as exemplarily shown in FIGS. 5 to 7, a first path portion 51-1 of the conveying path 51 which extends from the transfer position PT to the fixing position PF, a sheet which is housed in the feed sheet housing portion 70, and that which is housed in the discharge sheet housing portion 80 are opposed to one another.

In a specific embodiment, the feed sheet housing portion 70 and the discharge sheet housing portion 80 are placed so that the first path portion 51-1, a sheet which is housed in the feed sheet housing portion 70, and that which is housed in the discharge sheet housing portion 80 are approximately parallel to one another. More specifically, the first path portion 51-1 is placed so as to be substantially horizontal, and also the feed sheet housing portion 70 and the discharge sheet housing portion 80 are placed so as to be substantially horizontal.

In the configuration such as shown in FIGS. 5 and 6, the discharging path 55 is sharply bent, and a load is applied to a sheet and images on the sheet. Therefore, for example, there occur curling of a sheet, sheet jamming due to curling, an image defect and toner staining due to rubbing on a toner image, and the like.

In an embodiment, as shown in FIG. 7, therefore, the feed sheet housing portion 70 is placed so as to be opposed to the first path portion 51-1 across a second path portion 51-2 of the conveying path which extends from the fixing position PF to the transfer position PT, and the discharge sheet housing portion 80 is placed so as to be opposed to the first path portion 51-1 across the second path portion 51-2 and the feed sheet housing portion 70. For example, the second path portion 51-2 is an approximately linear path portion which is opposed to the first path portion 51-1 across the image carrier 10, and which conveys a sheet in the direction opposite to that of the first path portion 51-1.

In the first path portion 51-1 extending from the transfer position PT to fixing position PF, from the viewpoints of excellent image formation, and the like, a sheet is preferably conveyed while upwardly directing an unfixed toner image, and the first path portion 51-1 is located below the second path portion 51-2. In a specific embodiment, as shown in FIG. 7, therefore, the conveying path 51, the feed sheet housing portion 70, and the discharge sheet housing portion 80 are arranged from the lower side in this sequence.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

an image carrier on which a plurality of toner images is formed, each of the toner images corresponding to a different color;

a developing unit that develops an electrostatic latent image formed on the image carrier to sequentially form the toner images on the image carrier;

a transferring unit that transfers the toner image formed on the image carrier to a sheet at a transfer position;

a fixing unit that fixes the toner image transferred to the sheet at a fixing position;

a conveying unit that conveys the sheet along a conveying path that circulates around the image carrier, to repeatedly transfer and fix the plurality of toner images to the sheet, each of the toner images being sequentially transferred and fixed to the sheet one at a time;

a sheet shape detecting unit that detects information indicative of a shape of the sheet that is conveyed through the conveying path;

a discharge position where the sheet is discharged from the conveying path, a feed position where the sheet is fed to the conveying path and a detection position where the information indicative of the shape of the sheet is detected by the sheet shape detecting unit are arranged in this sequence along a sheet conveying direction to be close to one another, immediately downstream in the sheet conveying direction from the fixing position where the toner image is fixed to the sheet, a distance from the feed position along the conveying path in the sheet conveying direction to the discharge position is greater than a distance from the discharge position along the conveying path in the sheet conveying direction to the feed position, and a distance from the feed position along the conveying path in the sheet conveying direction to the transfer position, where each of the toner images is sequentially transferred to the sheet one at a time, is greater than a distance from the transfer position along the conveying path in the sheet conveying direction to the feed position, wherein the discharge position, the feed position and the detection position are on a same side with respect to a first plane which is perpendicular to a second plane connecting the transfer position of the transferring unit to the fixing position of the fixing unit and which passes through the transfer position, the second plane connecting the transfer position of the transferring unit to the fixing position of the fixing unit being substantially vertical, and wherein a length of a conveying path extending from the detection position to the transfer position in the conveying direction is equal to or greater than the maximum sheet length for the image forming apparatus.

2. The image forming apparatus according to claim 1, further comprising:

a feed sheet housing portion for housing the sheet prior to conveyance along the conveying path; and a discharge sheet housing portion for housing the sheet after discharge from the conveying path, wherein the feed sheet housing portion and the discharge sheet housing portion are placed so that a first path portion of the conveying path, the first path portion extending from the transfer position to the fixing position, a sheet which is housed in the feed sheet housing portion, and a sheet which is housed in the discharge sheet housing portion are opposed to one another.

3. The image forming apparatus according to claim 2, wherein the feed sheet housing portion is placed to be opposed to the first path portion across a second path portion of the conveying path, the second path portion extending from the fixing position to the transfer position, and the discharge sheet housing portion is placed to be opposed to the first path portion across the second path portion and the feed sheet housing portion.

4. An image forming apparatus comprising:

an image carrier on which a plurality of toner images is formed, each of the toner images corresponding to a different color;

a developing unit that develops an electrostatic latent image formed on the image carrier to sequentially form the toner images on the image carrier;

a transferring unit that transfers the toner image formed on the image carrier to a sheet at a transfer position;

a fixing unit that fixes the toner image transferred to the sheet at a fixing position;

a conveying unit that conveys the sheet along a conveying path that circulates around the image carrier, to repeatedly transfer and fix the plurality of toner images to the sheet, each of the toner images being sequentially transferred and fixed to the sheet one at a time;

a sheet shape detecting unit that detects information indicative of a shape of the sheet that is conveyed through the conveying path;

a discharge position where the sheet is discharged from the conveying path, a feed position where the sheet is fed to the conveying path and a detection position where the information indicative of the shape of the sheet is detected by the sheet shape detecting unit are arranged in this sequence along a sheet conveying direction to be close to one another, immediately downstream in the sheet conveying direction from the fixing position where the toner image is fixed to the sheet, wherein the discharge position, the feed position and the detection position are on a same side with respect to a first plane which is perpendicular to a second plane connecting the transfer position of the transferring unit to the fixing position of the fixing unit and which passes through the transfer position, the second plane connecting the transfer position of the transferring unit to the fixing position of the fixing unit being substantially vertical, and wherein a length of a conveying path extending from the detection position to the transfer position in the conveying direction is equal to or greater than the maximum sheet length for the image forming apparatus.

* * * * *